US005871129A

United States Patent [19]

Boncompagni

[11] Patent Number: 5,871,129

[45] Date of Patent: Feb. 16, 1999

[54] BUCKLE FOR BELT WITH COMPARTMENT

[75] Inventor: Giancarlo Boncompagni, Lorence, Italy

[73] Assignee: O.B.I. Officina Bigiotterie Italiana S.p.A., Lorence, Italy

[21] Appl. No.: 903,074

[22] Filed: Jul. 30, 1997

[30] Foreign Application Priority Data

Aug. 2, 1996 [IT] Italy ..... FI96 0088 U
Aug. 16, 1996 [IT] Italy ..... FI96 0161 U

[51] Int. Cl.[6] ..... A44B 11/00

[52] U.S. Cl. ..... 224/163; 224/191; 224/199; 24/163 K; 24/191

[58] Field of Search ..... 224/101, 163, 224/191, 197, 199; 24/163 K, 311, 316, 317, 180, 191

[56] References Cited

U.S. PATENT DOCUMENTS 1,578,468 3/1926 Rankin .
2,182,194 12/1939 Blau ..... 224/197
3,927,442 12/1975 Foster .
4,113,157 9/1978 Woodbury .
4,209,117 6/1980 Corinaldi et al. .
4,326,280 4/1982 Perry, Jr. ..... 224/163
5,217,150 6/1993 Chen ..... 224/163
5,357,638 10/1994 Mayzel .

FOREIGN PATENT DOCUMENTS 683040 2/1930 France ..... 224/163
2 266 031 10/1941 France .
1 515 451 6/1924 United Kingdom .

*Primary Examiner*—Allan N. Shoap
*Assistant Examiner*—Gregory M. Vidovich
*Attorney, Agent, or Firm*—McGlew Nd Tuttle

[57] ABSTRACT

The buckle (1) comprises a compartment (11) that cannot be seen from the outside, for holding small objects, the compartment being easily accessible to the user who is wearing the buckle.

6 Claims, 4 Drawing Sheets

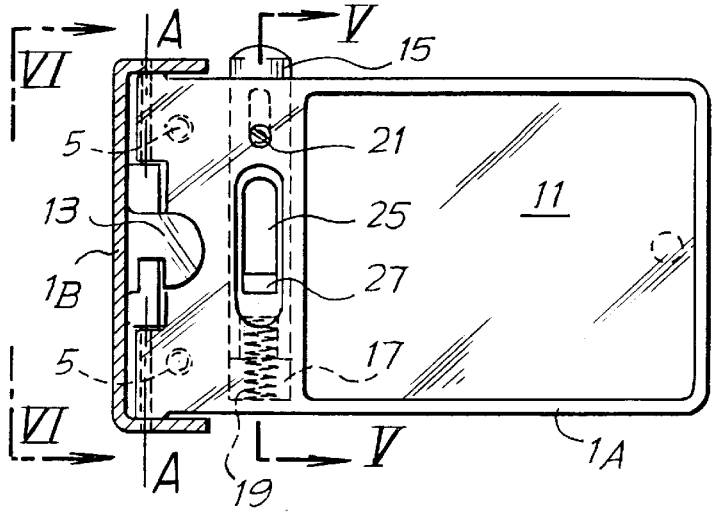
Fig. 4
Fig. 5
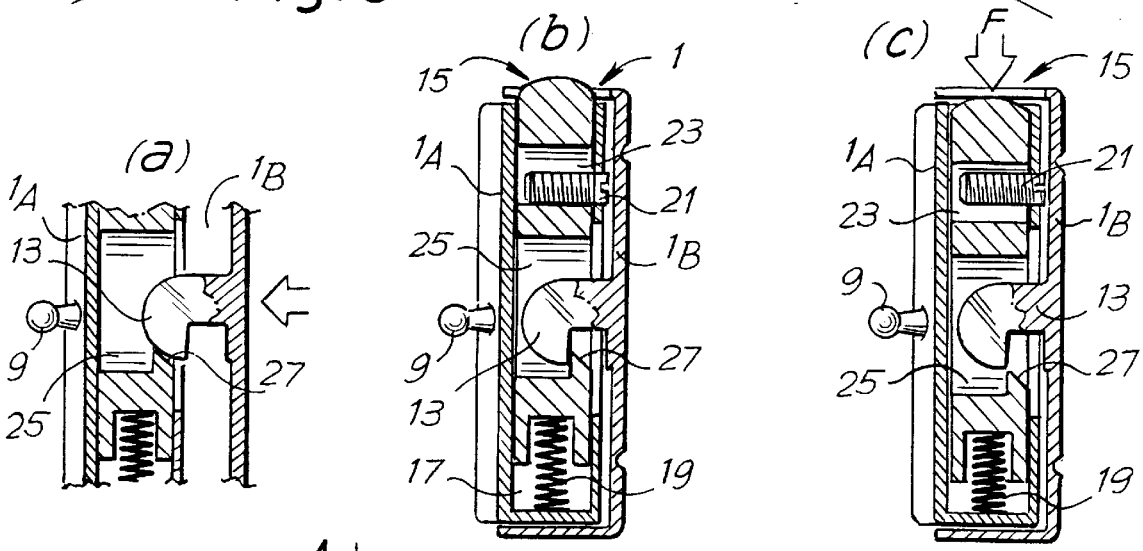
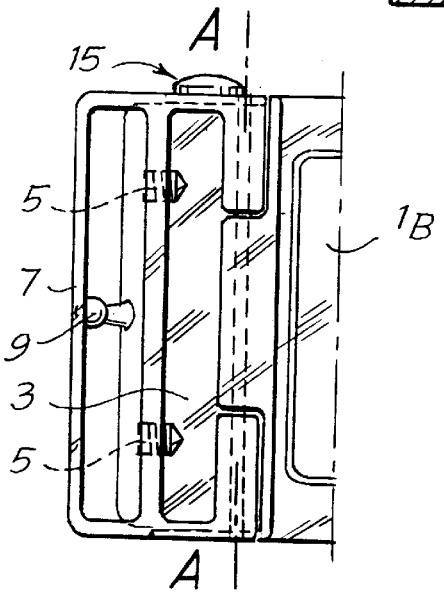
Fig. 6

BUCKLE FOR BELT WITH COMPARTMENT

FIELD AND BACKGROUND OF THE INVENTION

The present invention relates to a special form of buckle for belts or the like.

SUMMARY OF THE INVENTION

In essence, according to the invention, the buckle comprises a cavity or compartment for holding small objects. The compartment is advantageously made in such a way as to be invisible from the outside.

In one practical embodiment the buckle is made with a body divided into two portions hinged together and provided with closure means. The body is similar in shape to an ordinary belt buckle, e.g. of the type comprising means for fixing it to one end of the belt and, at the opposite end, a pin intended to be inserted through the holes of the belt, the free end of which passes behind the body of the buckle and through a bridge integral with the body itself.

The means for closing the compartment or cavity may be, for example, spring means advantageously operated by a button located in the upper or lower edge of the buckle. In one practical embodiment, the closure means comprise a slider able to slide in a seat formed in one of the two portions of the body of the buckle and spring-loaded towards a closure position in which it engages, by means of a tooth, a hook integral with the other portion of the body of the buckle. The pin advantageously has one end projecting from the sliding seat in order to be easily operated by the user. The tooth may have a bevel or other profile that is acted upon by the hook in such a way that the buckle can be closed by simple pressure between the two portions of the body of the buckle.

According to a particularly advantageous embodiment of the invention the compartment is formed by two portions hinged together and defining the body of the buckle; one of said portions is attached to a plate and rotates relative to the latter about an axis that is essentially perpendicular to the axis of the hinge which unites the two portions one to the other. Closure means are also provided to keep the two portions in a position of closure of the compartment defined between them, when the first portion is at a particular angle with respect to the plate to which it is hinged.

In one further possible embodiment, the plate has attachment means for fixing it to the belt or equivalent article. These means may be of conventional type.

The means for closing together the first and second portions of the buckle that define the secret compartment may comprise a hook and a tooth that are integral with the second of the two portions and with the plate to which the first portion is hinged, respectively, or vice versa. The hook and the tooth are disconnectable by a movement of rotation between the two portions, on the one hand, and the plate, on the other.

Other possible features are described below and indicated in the accompanying claims.

BRIEF DESCRIPTION OF THE DRAWINGS

The drawings show possible embodiments of the invention. In the drawings:

FIG. 4 shows a front view and partial cross-section of the open buckle;

FIG. 5 shows three different positions of the means of closing the compartment in a cross-section on V—V as marked in FIG. 4, FIG. 6 shows a side view on VI—VI as marked in FIG. 4;

DETAILED DESCRIPTION OF PREFERRED EMBODIMENTS

Figure 1:
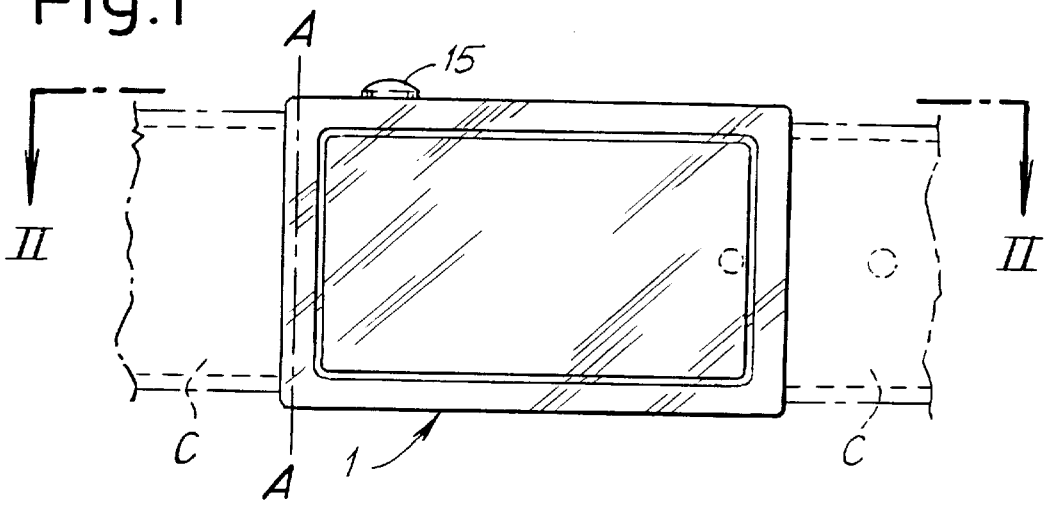
FIG. 1 shows a front view of the closed buckle.

Referring first to FIGS. 1–6, the buckle comprises a body 1 in two parts 1A and 1B hinged to each other on the axis A—A. Portion 1A possesses, down one edge, a seat in the form of a slot 3 in which one end of a belt C is fixed with fastening screws 5. At the same end as the edge with the seat 5 is a bridge 7 through which the other end of the belt C is passed when it is put on and closed. Closure is by means of a pin 9 integral with portion 1A of the buckle body 1.

Figure 2:
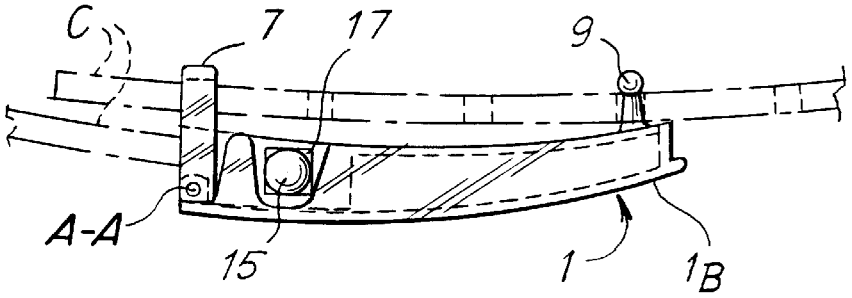
FIG. 2 shows a top view on II—II as marked in FIG. 1.
Figure 3:
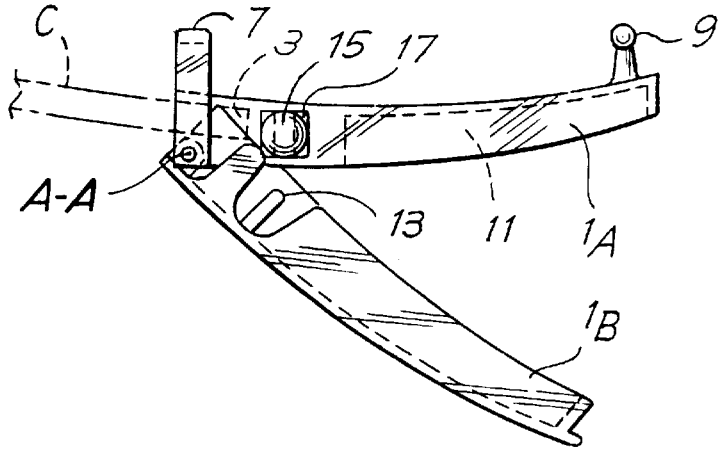
FIG. 3 shows a top view of the buckle with the compartment open.
Figure 7:
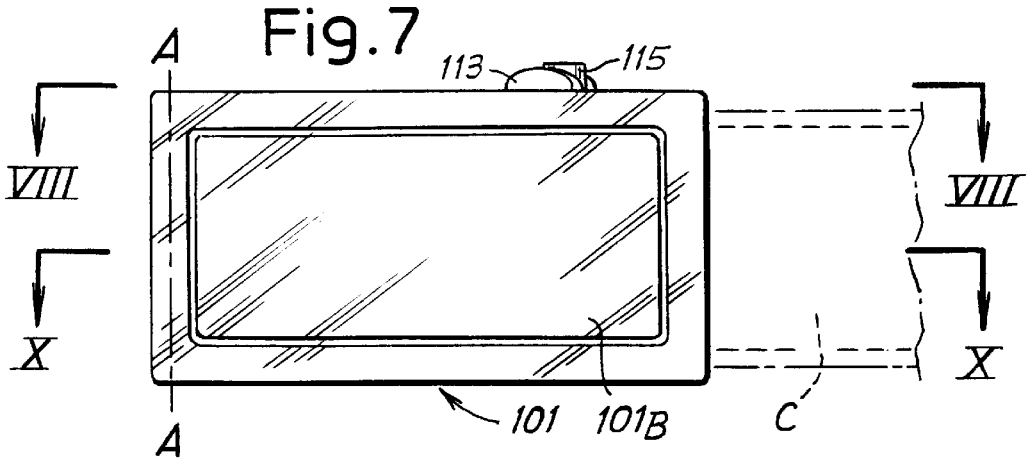
FIG. 7 shows a front view of the buckle in a second embodiment.

Formed in portion 1A is a compartment 11 closed by portion 1B (FIG. 2). In the closed position the buckle has the appearance of an ordinary buckle without any compartment.

In order to lock portion 1B in the closed position, said portion possesses a hook 13 which, in the example shown, is situated close to the hinge axis A—A. The hook 13 engages with a slider 15 that slides axially in a seat 17 formed in portion 1A. The slider 15 is loaded by a compression spring 19, arranged in the closed end of the seat 17, towards a stop 21 formed by a headless screw reaching into a transverse slot 23 in the slider 15 (see FIGS. 5*b* and 5*c*). Below the slot, the slider 15 has an aperture 25 into which the hook enters and next to which is a bevelled tooth 27 on which the hook 13 engages. FIGS. 5*a*–5*b* show how the hook 13 engages on the tooth 27 by simple pressure. FIG. 5*c* shows how, by pushing in direction F on the end of the slider 15 projecting from the seat 17, the slider 15 is disconnected from the hook 13.

The buckle disclosed above can be used to conceal, in an invisible compartment, objects of small dimensions, such as valuable objects or objects for personal and intimate use.

FIGS. 7–12 show a different and improved embodiment of the buckle according to the invention, which will now be described in more detail. The buckle comprises a body 101 formed by two portions 101A and 101B hinged together about axis A—A. Portion 101A is hinged to a plate 104 about an axis B—B that is oblique with respect to axis A—A and at 90° with respect thereto. The plate 104 has a toothed tongue 105 for fixing it to the end of the belt C. 107 is a bridge through which the other end of the belt C is passed when the belt is put on and closed. The belt is closed by means of the pin 109 integral with portion 101A of the body 101 of the buckle.

Figure 8:
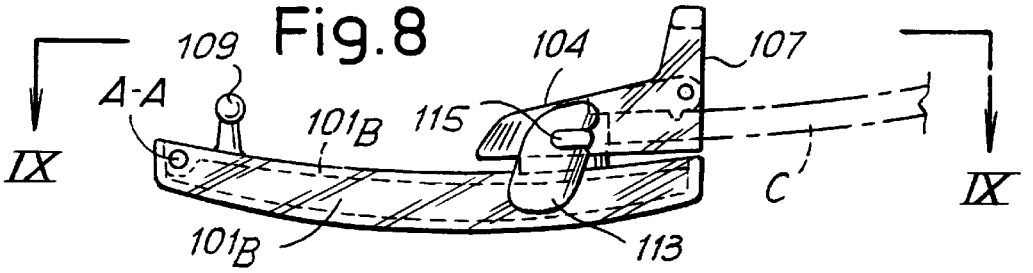
FIG. 8 shows a top view on VIII—VIII as marked in FIG. 7.
Figure 9:
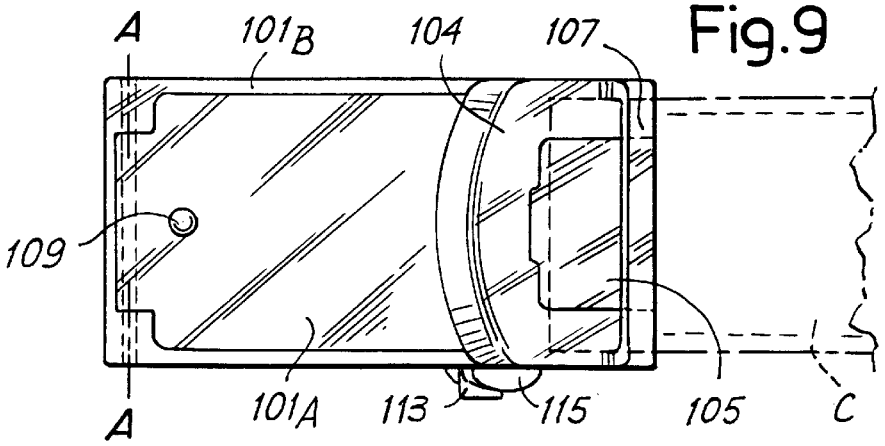
FIG. 9 shows a rear view on IX—IX as marked in FIG. 8 with the buckle rotated such that the belt C remains extending to the right to remain consistent with FIG. 8.
Figure 10:
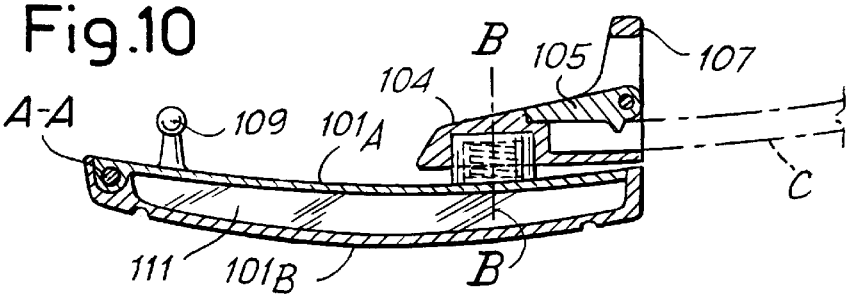
FIG. 10 shows a longitudinal section on X—X as marked in FIG. 7.
Figure 11:
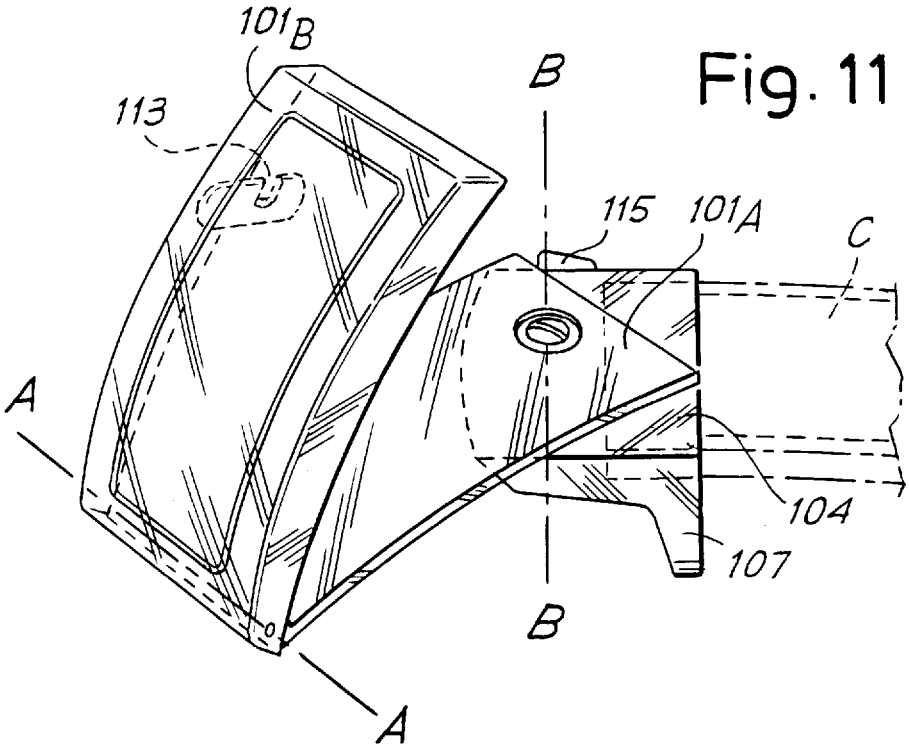
FIG. 11 shows a perspective view of the open buckle of FIG. 7.
Figure 12:
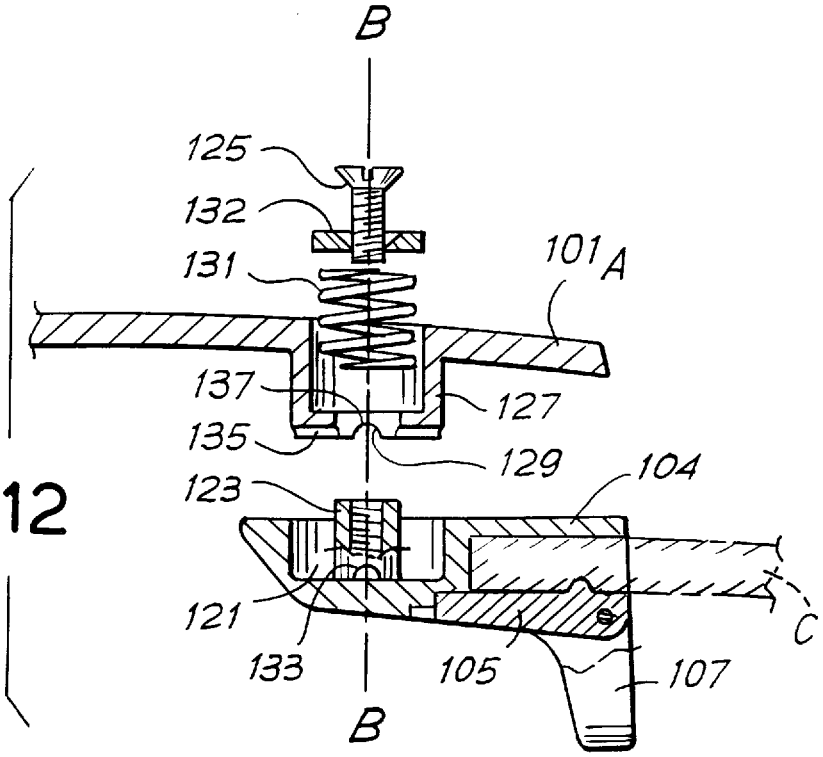
FIG. 12 shows an enlarged section of the hinge area between the plate and the first of the two portions forming the secret compartment of the buckle.

Formed between portions 101A and 101B is a compartment 111 that is invisible from the outside when the two portions 101A and 101B are in the closed position as shown in FIGS. 7 to 10. Closing the two portions 101A and 101B upon each other is done by means of a hook 113 integral with portion 101B and engaging with a tooth 115 integral with the plate 104. This arrangement can of course be reversed. As can be seen in FIG. 8 in particular, the shapes of the hook 113 and tooth 115 are such as to allow the hook to withdraw from the tooth when the body formed by portions 101A, 101B is rotated about axis of rotation B—B. In this way, by freeing the hook 113 from the tooth 115 it is possible to rotate portion 101B about the hinge axis A—A with respect to portion 101A and open the secret compartment, as shown in the perspective view of FIG. 11.

Portion 101A and the plate 104 are hinged together in such a way that the open and closed positions, which are at different angles, can both be locked. The mechanism of the hinge connection between the plate 104 and portion 101A is illustrated in an exploded view in FIG. 12. The plate 104 has a circular annular seat 121 containing a central hinge pin 123 whose axis coincides with the hinge axis B—B between the plate 104 and portion 101A. The pin 123 contains a tapped axial hole for a fastening screw 125. On the back of portion 101A is a cup-like protrusion 127 ending in a hole 129 coaxial with the pin 123. The outer diameter of the protrusion 127 is such as to allow the insertion of said protrusion into the seat 121. When the portion 127 is inserted into said seat the pin 123 passes through the hole 129, and portion 101A can be fastened to the plate 104 with the screw 125 which fits into the tapped hole in the pin 123. A compression spring 131 is arranged between a washer 132 and the closed end of the cup-like portion 127 so as to press portion 101A against portion 104. On the closed end of the seat 121 is a diametric relief 133 which can be inserted into one or other of two mutually perpendicular channels 135 and 137 formed in the outer surface of the bottom wall of portion 127. In this way portion 101A can assume two stable positions at 90° to each other on the plate 104. One of the two positions corresponds to the closed position (FIGS. 7 to 10) and the other to a fully open position of the compartment defined between portions 101A and 101B of the body 101 of the buckle.

I claim:

1. A buckle for belts, comprising:

a body divided into a first portion hinged to a second portion about a housing portion axis, said body defining a compartment that cannot be seen from an outside of the buckle, for holding small objects;

a body closure means for maintaining said two portions in a closed position;

a plate, said first portion being pivotably attached to said plate about a plate axis that is substantially skewed and perpendicular to said housing portion axis, said body closure means maintaining said first portion and said second portion in a position with said compartment closed when said first portion is at a predetermined angle with respect to said plate wherein said closure means allows said two portions to open into a position of opening when said first portion is pivoted from said predetermined angle with respect to said plate.

2. The buckle according to claim 1, further comprising:

a bridge formed on said plate;

belt fixing means for fixing said body to an end of a belt; and a pin at an end of said body opposite said belt fixing means, said pin for being inserted through a hole provided on said belt whereby a free end of said belt passes behind said body and through said bridge.

3. The buckle according to claim 1, wherein said plate includes an attachment device connecting said buckle to a belt.

4. The buckle according to claim 1, wherein said closure means includes a hook and a tooth, one of said hook and tooth being formed integral with said second portion and the other said hook and said tooth being formed integral with said plate whereby said hook and tooth are disconnectable upon rotation of said two portions above said plate axis relative to said plate.

5. The buckle according to claim 1, wherein said first portion is pivotally attached to said plate via a hinge pin and an interposed spring member.

6. The buckle according to claim 5, wherein said spring member acts to press said plate and said first portion against each other, said plate and said first portion having mutually engaging profiles for stabilizing said plate and said first portion in one or two relative angular positions.

* * * * *

UNITED STATES PATENT AND TRADEMARK OFFICE

CERTIFICATE OF CORRECTION

PATENT NO. : 5,871,129

DATED : February 16, 1999

INVENTOR(S) : BONCOMPAGNI

It is certified that error appears in the above-indentified patent and that said Letters Patent is hereby corrected as shown below:

Title page, should read-- item [75] Inventor: Giancarlo Boncompagni, Florence, Italy-- item [73] Assignee: O.B.I. Officina Bigiotterie Italiana S.p.A., Florence, Italy--

Signed and Sealed this

Thirtieth Day of November, 1999

*Attest:*

*Attesting Officer*

Q. TODD DICKINSON

*Acting Commissioner of Patents and Trademarks*